US011415929B2

(12) United States Patent
Takahashi et al.

(10) Patent No.: US 11,415,929 B2
(45) Date of Patent: Aug. 16, 2022

(54) IMAGE FORMING APPARATUS IN WHICH HIGH-VOLTAGE ELECTRICAL CIRCUIT BOARD IS LOCATED IN FIRST REGION AND MOTORS AND CONTROL BOARD ARE LOCATED IN SECOND REGION

(71) Applicant: BROTHER KOGYO KABUSHIKI KAISHA, Nagoya (JP)

(72) Inventors: Osamu Takahashi, Nagoya (JP); Masaaki Wakizaka, Nagoya (JP); Kentaro Aoyama, Nagoya (JP); Shunsuke Hachiya, Nagoya (JP); Toshinori Araki, Hekinan (JP); Keita Inoue, Konan (JP); Shinta Sugiura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/181,146

(22) Filed: Feb. 22, 2021

(65) Prior Publication Data

US 2021/0271182 A1 Sep. 2, 2021

(30) Foreign Application Priority Data

Feb. 28, 2020 (JP) ..... JP2020-033661

(51) Int. Cl.
*G03G 21/16* (2006.01)
*G03G 15/00* (2006.01)
(Continued)

(52) U.S. Cl.
CPC ..... *G03G 21/1604* (2013.01); *G03G 15/80* (2013.01); *G03G 21/1642* (2013.01);
(Continued)

(58) Field of Classification Search
CPC ..... G03G 21/1604; G03G 21/1642; G03G 21/1652; G03G 15/80
See application file for complete search history.

(56) References Cited

U.S. PATENT DOCUMENTS 7,873,294 B2 * 1/2011 Nobe ..... G03G 15/6502 399/88
10,295,948 B2 * 5/2019 Nakamura ..... G03G 21/203
(Continued)

FOREIGN PATENT DOCUMENTS

JP 2015-69095 A 4/2015
JP 2016-224084 A 12/2016

*Primary Examiner* — Arlene Heredia
(74) *Attorney, Agent, or Firm* — Merchant & Gould P.C.

(57) ABSTRACT

A high-voltage electrical circuit board is located in a first region that is a region at one side of photosensitive drums in a first direction and outside of the photosensitive drums in the first direction. A first motor drives a conveyance mechanism. A second motor is located in a second region and drives each photosensitive drum. A third motor is located in the second region and drives each developing roller to rotate and to drive a separation mechanism configured to individually move the developing rollers between a contact position and a separation position. A control board is located in the second region. The control board includes a controller configured to control a first applying circuit, the first motor, the second motor, and the third motor. The first motor, the second motor, the third motor, and the control board are located at different positions from one another in the second region.

11 Claims, 11 Drawing Sheets

(51) Int. Cl.
*G03G 21/20* (2006.01)
*G03G 15/02* (2006.01)

(52) U.S. Cl.
CPC ..... *G03G 21/1652* (2013.01); *G03G 15/0266* (2013.01); *G03G 21/203* (2013.01)

(56) References Cited

U.S. PATENT DOCUMENTS

| | | | | |
|---|---|---|---|---|
| 2015/0016835 | A1* | 1/2015 | Kakutani | G03G 15/80 399/88 |
| 2015/0093145 | A1 | 4/2015 | Tomatsu et al. | |
| 2016/0349693 | A1 | 12/2016 | Matsuno | |
| 2020/0387081 | A1* | 12/2020 | Sakaguchi | G03G 15/0822 |

* cited by examiner

IMAGE FORMING APPARATUS IN WHICH HIGH-VOLTAGE ELECTRICAL CIRCUIT BOARD IS LOCATED IN FIRST REGION AND MOTORS AND CONTROL BOARD ARE LOCATED IN SECOND REGION

CROSS REFERENCE TO RELATED APPLICATIONS

This application claims priority from Japanese Patent Application No. 2020-033661 filed Feb. 28, 2020. The entire content of the priority application is incorporated herein by reference.

TECHNICAL FIELD

This disclosure relates to an image forming apparatus.

BACKGROUND

An image forming apparatus including a high-voltage electrical circuit board that supplies a high voltage to an image forming unit is known.

SUMMARY

According to one aspect, this specification discloses an image forming apparatus. The image forming apparatus includes a main housing, a plurality of developing rollers, a drum unit, a high-voltage electrical circuit board, a first motor, a second motor, a third motor, and a control board. Each of the plurality of developing rollers is rotatable about a first axis extending in a first direction. The plurality of developing rollers is arranged in a second direction. The drum unit includes a plurality of photosensitive drums and a plurality of chargers. The plurality of photosensitive drums is provided for respective ones of the plurality of developing rollers. Each of the plurality of photosensitive drums is rotatable about a second axis extending in the first direction. Each of the plurality of chargers is configured to charge a surface of a corresponding one of the plurality of photosensitive drums. The high-voltage electrical circuit board is located in a first region that is a region at one side of the plurality of photosensitive drums in the first direction and outside of the plurality of photosensitive drums in the first direction. The high-voltage electrical circuit board includes a first applying circuit configured to apply a voltage to the plurality of chargers. The first motor is located in a second region that is a region at an other side of the plurality of photosensitive drums in the first direction and outside of the plurality of photosensitive drums in the first direction, the other side being opposite the one side. The first motor is configured to drive a conveyance mechanism configured to convey a sheet. The second motor is located in the second region and is configured to drive each of the plurality of photosensitive drums. The third motor is located in the second region. The third motor is configured to drive each of the plurality of developing rollers to rotate and to drive a separation mechanism configured to individually move the plurality of developing rollers between a contact position at which each of the plurality of developing rollers contacts a corresponding one of the plurality of photosensitive drums and a separation position at which each of the plurality of developing rollers is separated from the corresponding one of the plurality of photosensitive drums. The control board is located in the second region. The control board includes a controller configured to control the first applying circuit, the first motor, the second motor, and the third motor. The first motor, the second motor, the third motor, and the control board are located at different positions from one another in the second region.

BRIEF DESCRIPTION OF THE DRAWINGS

Embodiments in accordance with this disclosure will be described in detail with reference to the following figures wherein.

DETAILED DESCRIPTION

It is desirable that a control board for controlling an image forming apparatus, a motor, and so on be located at a particular distance from a high-voltage electrical circuit board in order to suppress the influence of high-frequency noise generated from the high-voltage electrical circuit board. For example, it is considered that the high-voltage electrical circuit board is located at one side of the image forming apparatus and the control board is located at the other side of the image forming apparatus, so that the control board is located at a particular distance from the high-voltage electrical circuit board. In this case, in a case where the image forming apparatus includes a plurality of motors, it is desirable that the plurality of motors is also located at a particular distance from the high-voltage electrical circuit board. However, if the control board and the motors are not properly arranged, the image forming apparatus becomes large.

In view of the foregoing, an aspect of an objective of this disclosure is to, by appropriately arranging the high-voltage electrical circuit board, the control board, and the motors, suppress the influence of high-frequency noise of the high-voltage electrical circuit board on the motors and the control board, and to suppress an increase in the size of the image forming apparatus.

Figure 1:
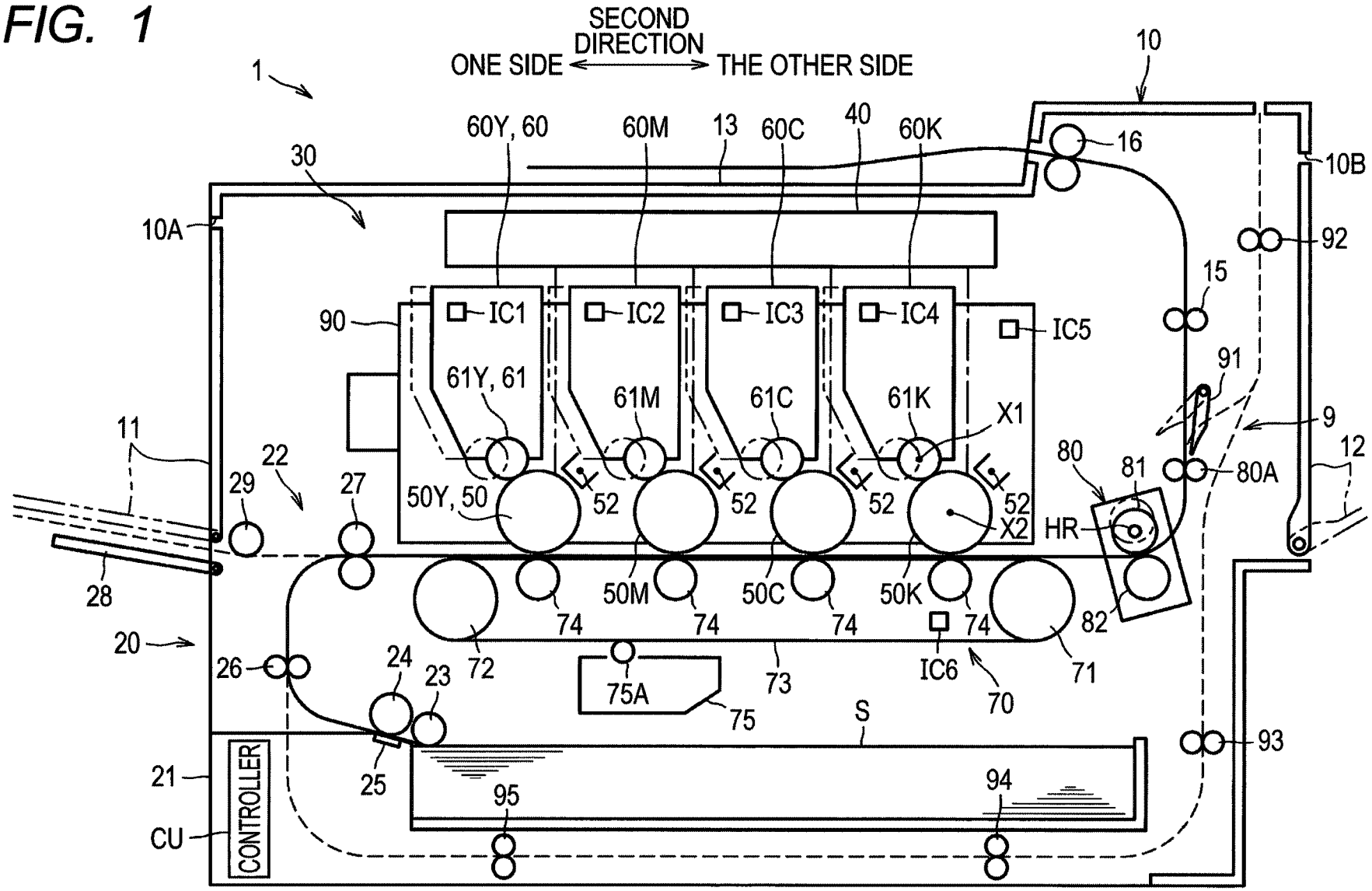
FIG. 1 is a diagram showing a schematic configuration of an image forming apparatus according to an embodiment.

As shown in FIG. 1, an image forming apparatus 1 is a color printer. The image forming apparatus 1 includes a main housing 10, a front cover 11, a rear cover 12, a sheet supply unit 20, an image forming unit 30, and a controller CU. In the present specification, the axial direction of developing rollers 61 is defined as a first direction, and the direction in which a plurality of development cartridges 60 are arranged is defined as a second direction. The second direction is a direction that crosses the first direction. Preferably, the second direction is perpendicular to the first direction.

The main housing 10 has a first opening 10A and a second opening 10B. The first opening is an example of an opening. The first opening 10A is located at one side in the second direction. The second opening 10B is located at the other side, which is opposite to the one side in the second direction. The front cover 11 is configured to move between a closed position for closing the first opening 10A shown by the solid line and an open position for opening the first opening 10A shown by the double-dot chain line. The rear cover 12 is configured to move between a closed position for closing the second opening 10B shown by the solid line and an open position for opening the second opening 10B shown by the double-dot chain line.

The sheet supply unit 20 includes a sheet tray 21, a supply mechanism 22, and a manual feed tray 28. The sheet tray 21 is located at the bottom part in the main housing 10. The sheet tray 21 accommodates a sheet S. The sheet tray 21 is configured to be detached by pulling the same out from the main housing 10 toward the left side of FIG. 1.

The supply mechanism 22 supplies the sheet S from the sheet tray 21 to the image forming unit 30. The supply mechanism 22 is provided in the main housing 10, and includes a paper feed roller 23, a separation roller 24, a separation pad 25, a conveyance roller 26, a registration roller 27, and a pickup roller 29. The sheet S of the present specification is a medium on which the image forming apparatus 1 forms an image, and includes plain paper, an envelope, a postcard, a thin paper, a thick paper, a glossy paper, a resin sheet, a sticker, and so on.

The manual feed tray 28 is located below the front cover 11. A sheet S can be placed on the manual feed tray 28. The sheet S placed on the manual feed tray 28 is supplied to the image forming unit 30 by the pickup roller 29.

In the sheet supply unit 20, after a sheet S in the sheet tray 21 is sent out by the paper feed roller 23, the sheet S is separated one sheet at a time between the separation roller 24 and the separation pad 25, and the sheet S is conveyed toward the registration roller 27 by the conveyance roller 26. After that, the leading end position of the sheet S is regulated by the registration roller 27 in a state where the rotation is stopped, and then the sheet S is supplied to the image forming unit 30 due to rotation of the registration roller 27.

The image forming unit 30 includes an exposure device 40, the plurality of development cartridges 60, a conveyance device 70, a fixing device 80, and a drawer 90 as an example of a drum unit.

The exposure device 40 includes a laser diode, a deflector, a lens, and a mirror (not shown). The exposure device 40 is configured to emit a plurality of laser beams that expose a plurality of photosensitive drums 50 to scan the surface of the photosensitive drums 50.

The drawer 90 has the plurality of photosensitive drums 50 and chargers 52. Each photosensitive drum 50 is rotatable about a second axis X2 that extends in the first direction. The photosensitive drums 50 are provided for respective ones of the plurality of developing rollers 61. The charger 52 charges the surface of the photosensitive drum 50.

The photosensitive drum 50 includes a first photosensitive drum 50Y, a second photosensitive drum 50M, a third photosensitive drum 50C, and a fourth photosensitive drum 50K. The first photosensitive drum 50Y corresponds to a first development cartridge 60Y containing yellow toner. The second photosensitive drum 50M corresponds to a second development cartridge 60M containing magenta toner. The third photosensitive drum 50C corresponds to a third development cartridge 60C containing cyan toner. The fourth photosensitive drum 50K corresponds to a fourth development cartridge 60K containing black toner. In this specification and drawings, Y, M, C, and K are omitted when the description is made without distinguishing colors.

The development cartridges 60 are provided for respective ones of the photosensitive drums 50. Specifically, the development cartridges 60 include the first development cartridge 60Y, the second development cartridge 60M, the third development cartridge 60C, and the fourth development cartridge 60K. The first development cartridge 60Y has a first developing roller 61Y that supplies toner to the first photosensitive drum 50Y. The second development cartridge 60M has a second developing roller 61M that supplies toner to the second photosensitive drum 50M. The third development cartridge 60C has a third developing roller 61C that supplies toner to the third photosensitive drum 50C. The fourth development cartridge 60K has a fourth developing roller 61K that supplies toner to the fourth photosensitive drum 50K.

The first development cartridge 60Y has a first development memory IC1 configured to store the information relating to the first development cartridge 60Y. The second development cartridge 60M has a second development memory IC2 configured to store the information relating to the second development cartridge 60M. The third development cartridge 60C has a third development memory IC3 configured to store the information relating to the third development cartridge 60C. The fourth development cartridge 60K has a fourth development memory IC4 configured to store the information relating to the fourth development cartridge 60K.

The first developing roller 61Y, the second developing roller 61M, the third developing roller 61C, and the fourth developing roller 61K are arranged in this order from the registration roller 27 toward the fixing device 80. The plurality of developing rollers 61 are arranged in the second direction. The plurality of developing rollers 61 is rotatable about a first axis X1 that extends in the first direction.

Each development cartridge 60 is configured to move between a contact position at which the developing roller 61 contacts the corresponding photosensitive drum 50 shown by the solid line in FIG. 1 and a separation position at which the developing roller 61 is separated from the corresponding photosensitive drum 50 shown by the double-dot chain line in FIG. 1.

Each photosensitive drum 50 is rotatably supported by the drawer 90. The drawer 90 detachably supports the first development cartridge 60Y, the second development cartridge 60M, the third development cartridge 60C, and the fourth development cartridge 60K. The drawer 90 has a drum memory IC 5 configured to store information relating to each photosensitive drum 50. The drawer 90 is configured to be attached to or detached from the main housing 10 through the first opening 10A.

The image forming apparatus 1 includes a separation mechanism configured to move the first developing roller 61Y, the second developing roller 61M, the third developing roller 61C, and the fourth developing roller 61K between a contact position at which the developing roller contacts the corresponding one of the plurality of photosensitive drums 50 and a separation position at which the developing roller is separated from the corresponding photosensitive drum 50. The separation mechanism is provided for each of the plurality of colors.

The conveyance device 70 is located between the sheet tray 21 and the photosensitive drums 50. The conveyance device 70 includes a drive roller 71, a follow roller 72, a conveyance belt 73 composed of an endless belt, four transfer rollers 74, a waste toner container 75, and a belt memory IC 6. The conveyance device 70 is configured to be attached to or detached from the main housing 10 through the first opening 10A or the second opening 10B.

The conveyance belt 73 is stretched between the drive roller 71 and the follow roller 72, and the outer surface of the conveyance belt 73 is arranged so as to face each photosensitive drum 50. Each transfer roller 74 is arranged inside the conveyance belt 73 with the conveyance belt 73 sandwiched between the transfer rollers 74 and the photosensitive drums 50. The conveyance device 70 conveys the sheet S by moving the conveyance belt 73 with the sheet S placed on the upper outer peripheral surface thereof, and at this time, transfers toner images of the plurality of photosensitive drums 50 onto the sheet S.

The waste toner container 75 is located between the sheet tray 21 and the conveyance belt 73. The waste toner container 75 has a cleaning roller 75A, and collects toner and so on adhering to the conveyance belt 73 to clean the conveyance belt 73.

The fixing device 80 is a device for fixing the toner on the sheet S. The fixing device 80 is located at the other side of the photosensitive drums 50 and the conveyance device 70 in the second direction. The fixing device 80 has a heating roller 81 and a pressure roller 82. The heating roller 81 has a heater HR that heats the heating roller 81 inside thereof. The pressure roller 82 is located to face the heating roller 81. A conveyance roller 15 is located above the fixing device 80, and a discharge roller 16 is located above the conveyance roller 15.

The heating roller 81 is configured to move between a nip position shown by the solid line in FIG. 1 and a nip release position shown by the double-dot chain line in FIG. 1. The nip position is a position where the heating roller 81 and the pressure roller 82 are pressed against each other. The nip release position is a position where the pressure between the heating roller 81 and the pressure roller 82 is smaller than that in the nip position. Specifically, the fixing device 80 includes a nip adjustment mechanism for moving the heating roller 81 between the nip position and the nip release position. At the nip release position, the heating roller 81 may or may not be in contact with the pressure roller 82. Further, the nip adjustment mechanism may be configured to move the pressure roller 82.

The controller CU includes, for example, a CPU, a RAM, a ROM, an EEPROM, and an input-output circuit. The controller CU executes print control by performing arithmetic processing based on the information relating to the mounted cartridge and the programs and data stored in the RAM, the ROM, and so on.

In the image forming unit 30 configured in this way, first, the surface of each photosensitive drum 50 is uniformly charged by the charger 52, and then exposed by the light emitted from the exposure device 40. As a result, an electrostatic latent image based on the image data is formed on each photosensitive drum 50.

Further, the toner in a case of the development cartridge 60 is borne on the surface of the developing roller 61, and when the developing roller 61 contacts the photosensitive drum 50, the toner is supplied to the electrostatic latent image formed on the photosensitive drum 50. As a result, a toner image is formed on the photosensitive drum 50.

Next, the sheet S supplied on the conveyance belt 73 passes between each photosensitive drum 50 and each transfer roller 74, so that the toner image formed on each photosensitive drum 50 is transferred onto the sheet S. Then, as the sheet S passes between the heating roller 81 and the pressure roller 82, the toner image transferred on the sheet S is thermally fixed to the sheet S.

The sheet S discharged from the fixing device 80 is stored on a discharge tray 13 on the upper surface of the main housing 10 by the conveyance roller 15 and the discharge roller 16. That is, the sheet S is discharged to the discharge tray 13.

Figure 2:
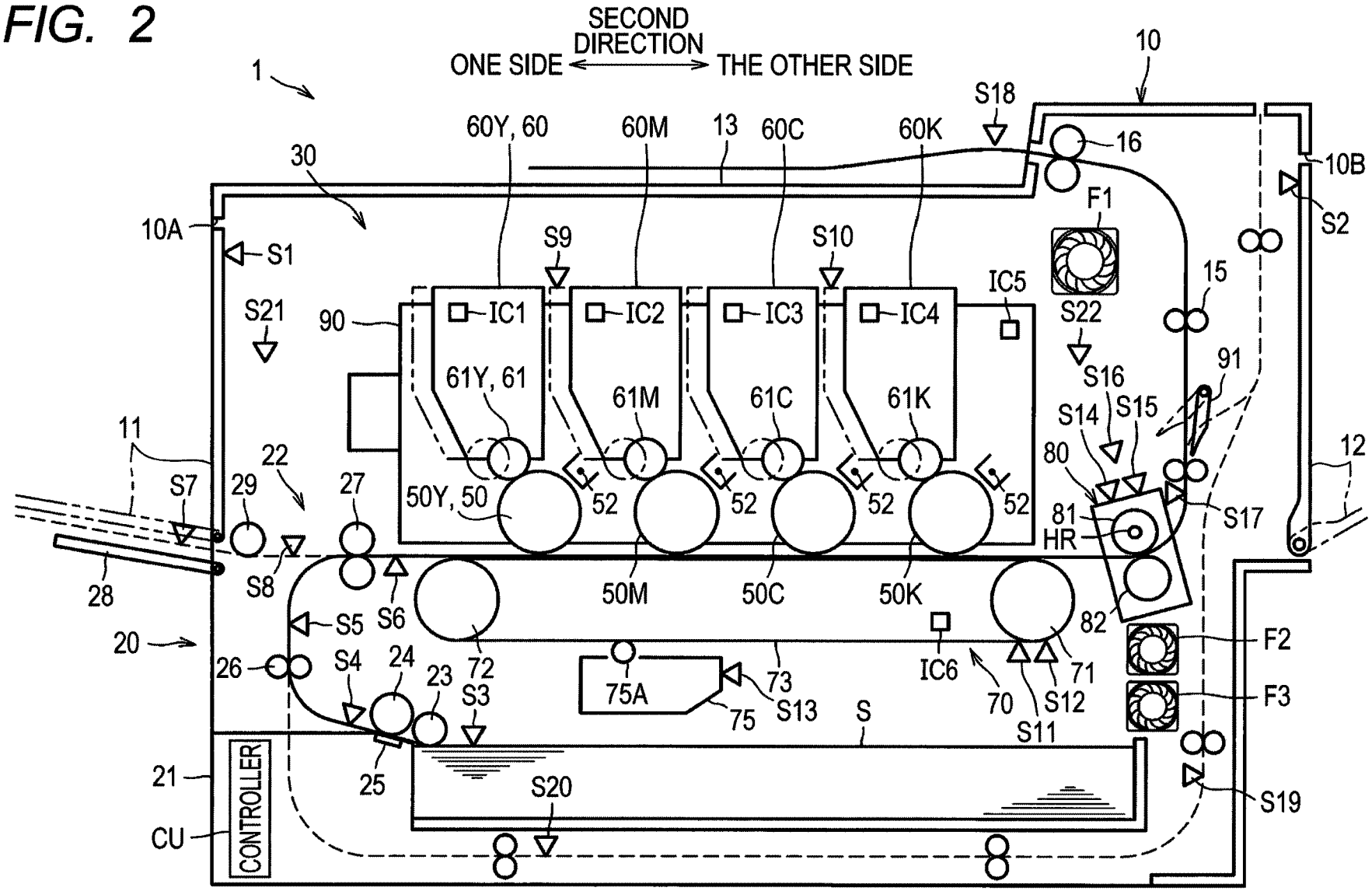
FIG. 2 is a schematic diagram showing the arrangement of sensors and fans of the image forming apparatus.
Figure 3:
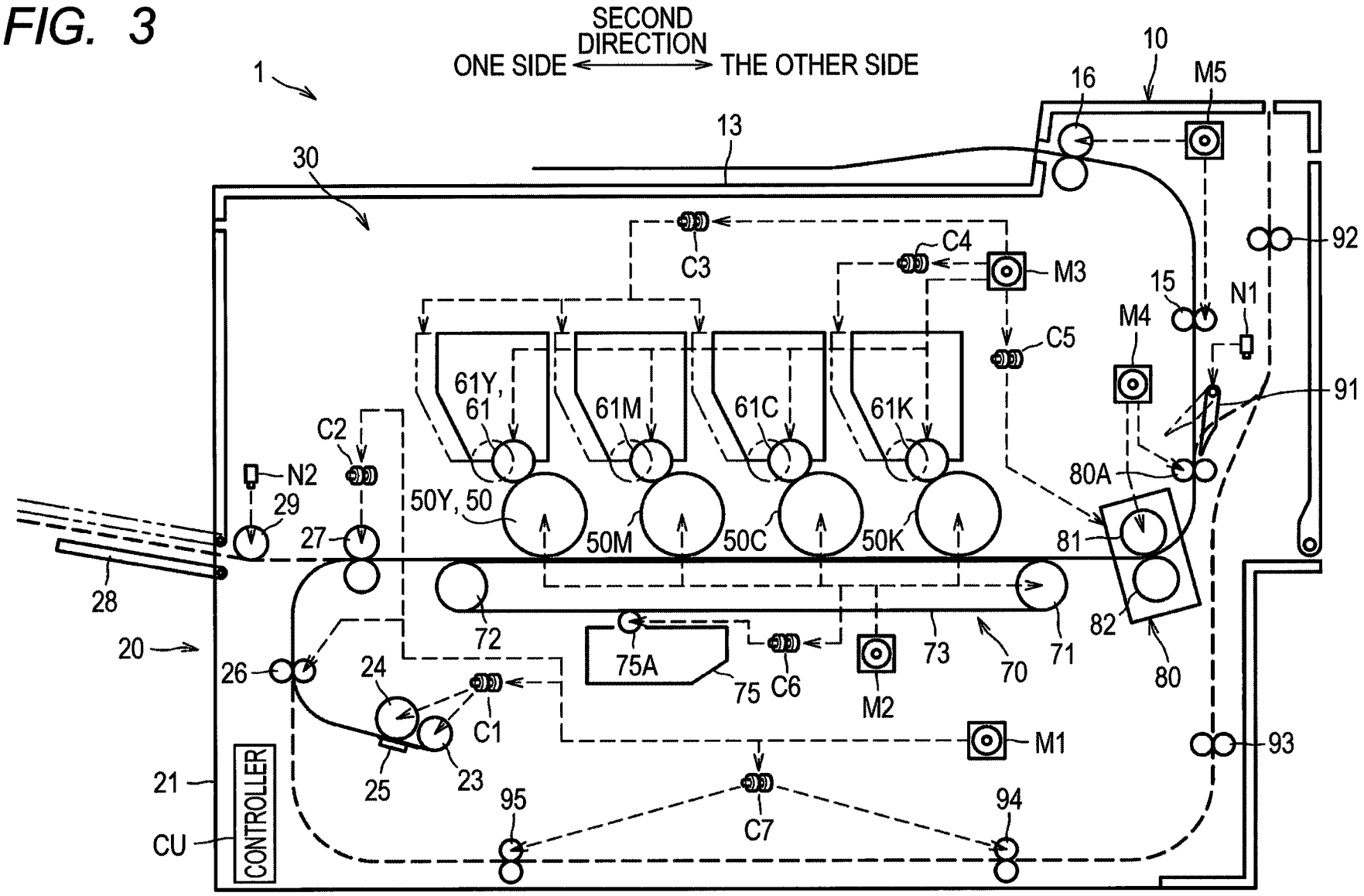
FIG. 3 is a diagram showing a control system of motors, clutches, and solenoids of the image forming apparatus.

The image forming apparatus 1 includes a reconveyance mechanism 9. The reconveyance mechanism 9 is a mechanism configured to, after an image is formed on the first surface of the sheet S, again conveys the sheet S to the image forming unit 30 with the front and back sides of the sheet S inverted, in order to form an image on the second surface on the back side of the sheet S. In FIGS. 1 to 3, a reconveyance path through which the sheet S is reconveyed and a path through which the sheet S is conveyed from the manual feed tray are shown by broken lines.

The reconveyance mechanism 9 includes a flapper 91, a switchback roller 92, and a plurality of reconveyance rollers 93, 94, 95.

The flapper 91 is configured to rotatably move between a third position shown by the solid line in FIG. 1 and a fourth position shown by the double-dot chain line in FIG. 1. When the flapper 91 is located at the third position, the flapper 91 guides the sheet S discharged from the fixing device 80 toward the discharge tray 13. When the flapper 91 is located at the fourth position, the flapper 91 guides the sheet S discharged from the fixing device 80 toward the switchback roller 92.

The switchback roller 92 is a roller capable of forward and reverse rotation. At the time of forward rotation, the switchback roller 92 conveys the sheet S to the outside of the main housing 10. At the time of reverse rotation, the switchback roller 92 pulls the sheet S into the main housing 10 and conveys the sheet S toward the reconveyance roller 93.

The plurality of reconveyance rollers 93, 94, 95 is located at positions along the reconveyance path of the sheet S. The plurality of reconveyance rollers 93, 94, 95 conveys the sheet S toward the image forming unit 30. The reconveyance roller 93 is arranged side by side with the sheet tray 21 in the second direction. The reconveyance rollers 94 and 95 are located below the sheet tray 21. The number and position of reconveyance rollers may be changed as appropriate.

As shown in FIG. 2, the image forming apparatus 1 includes a plurality of sensors. A signal detected by each sensor is sent to the controller CU. Specifically, the image forming apparatus 1 includes a front cover sensor 51, a rear cover sensor S2, a sheet tray sensor S3, a paper trailing end sensor S4, a pre-registration sensor S5, a post-registration sensor S6, a manual feed tray sensor S7, a manual feed tray pre-registration sensor S8, a color development separation sensor S9, a monochrome development separation sensor S10, a first registration mark sensor S11, a second registration mark sensor S12, a waste toner sensor S13, a center temperature sensor S14, a side temperature sensor S15, a nip release sensor S16, a discharge sensor S17, a discharged paper stack sensor S18, a reverse paper discharge sensor S19, a reconveyance path sensor S20, a temperature-humidity sensor S21, and an in-apparatus thermistor S22.

The front cover sensor 51 is located at the first opening 10A. The front cover sensor 51 detects the opening and closing of the front cover 11.

The rear cover sensor S2 is located at the second opening 10B. The rear cover sensor S2 detects the opening and closing of the rear cover 12.

The sheet tray sensor S3 is located at the upper part of the sheet tray 21. The sheet tray sensor S3 detects the sheet S placed in the sheet tray 21. Specifically, the sheet tray sensor S3 detects whether the sheet S exists in the sheet tray 21.

The paper trailing end sensor S4 is located in the vicinity of the outlet of the sheet tray 21 of the sheet S. The paper trailing end sensor S4 detects the trailing end of the sheet S conveyed from the sheet tray 21.

The pre-registration sensor S5 is located downstream of the paper trailing end sensor S4 and upstream of the registration roller 27 in the conveyance direction of the sheet S. The pre-registration sensor S5 detects the passage of the sheet S.

The post-registration sensor S6 is located downstream of the registration roller 27 and upstream of the photosensitive drum 50 in the conveyance direction of the sheet S. The post-registration sensor S6 detects the passage of the sheet S.

The manual feed tray sensor S7 is located close to the manual feed tray 28. The manual feed tray sensor S7 detects the sheet S placed in the manual feed tray 28. Specifically, the manual feed tray sensor S7 detects whether the sheet S exists in the manual feed tray 28.

The manual feed tray pre-registration sensor S8 is located between the manual feed tray sensor S7 and the post-registration sensor S6. The manual feed tray pre-registration sensor S8 detects the passage of the sheet S conveyed from the manual feed tray 28.

The color development separation sensor S9 is located in a separation mechanism that moves the first development cartridge 60Y, the second development cartridge 60M, and the third development cartridge 60C. The color development separation sensor S9 detects whether the first development cartridge 60Y, the second development cartridge 60M, and the third development cartridge 60C are located at a separation position. Specifically, the color development separation sensor S9 detects the phase of a cam (not shown) that separates the first development cartridge 60Y, the second development cartridge 60M, and the third development cartridge 60C from the corresponding photosensitive drum.

The monochrome development separation sensor S10 is located in a separation mechanism that moves the fourth development cartridge 60K. The color development separation sensor S9 detects whether the fourth development cartridge 60K is located at the separation position. Specifically, the monochrome development separation sensor S10 detects the phase of a cam (not shown) that separates the fourth development cartridge 60K from the corresponding photosensitive drum.

The first registration mark sensor S11 is located close to the drive roller 71. The first registration mark sensor S11 detects the color shift of the registration mark transferred on the conveyance belt 73. The second registration mark sensor S12 is located close to the drive roller 71. The second registration mark sensor S12 detects the printing density of the registration mark transferred on the conveyance belt 73. The controller CU adjusts the print position and the print density based on the color shift and the print density of the registration mark detected by the first registration mark sensor S11 and the second registration mark sensor S12.

The waste toner sensor S13 is located close to the waste toner container 75. The waste toner sensor S13 detects the amount of the waste toner accumulated in the waste toner container 75.

The center temperature sensor S14 is located to face a center part of the heating roller 81 in the axial direction. The center temperature sensor S14 is a noncontact-type infrared sensor. The center temperature sensor S14 measures the temperature at the center part of the heating roller 81 in the axial direction.

The side temperature sensor S15 is located to face an end part of the heating roller 81 in the axial direction. The side temperature sensor S15 is a contact-type thermistor. The side temperature sensor S15 measures the temperature of the end part of the heating roller 81 in the axial direction.

The nip release sensor S16 is located at the fixing device 80. The nip release sensor S16 detects whether the fixing device 80 is in a nip state or a release state. Specifically, the nip release sensor S16 detects the position of a cam (not shown) that switches the nip state and the nip release state of the fixing device 80.

The discharge sensor S17 is located between the fixing device 80 and the flapper 91. The discharge sensor S17 detects the discharge of the sheet S from the fixing device 80.

The discharged paper stack sensor S18 is located at the discharge tray 13. The discharged paper stack sensor S18 detects whether a particular number of sheets S are loaded in the discharge tray 13.

The reverse paper discharge sensor S19 is located at the reconveyance path. The reverse paper discharge sensor S19 detects the existence or nonexistence of the sheet S in the reconveyance path.

The reconveyance path sensor S20 is located at a position along the reconveyance path and at a lower part of the sheet tray 21. The reconveyance path sensor S20 detects the existence or nonexistence of the sheet S in the reconveyance path.

The temperature-humidity sensor S21 measures the temperature and humidity outside the main housing 10.

The in-apparatus thermistor S22 measures the temperature inside the main housing 10.

The image forming apparatus 1 includes a plurality of fans. The respective fans are controlled by the controller CU. Specifically, the image forming apparatus 1 includes a fixing fan F1, a power supply fan F2, and a charger fan F3.

The fixing fan F1 is located at an upper part of the fixing device 80. The fixing fan F1 mainly allows the heat discharged from the fixing device 80 to escape to outside the main housing 10.

The power supply fan F2 is located close to a power supply device (not shown). The power supply fan F2 mainly allows the heat discharged from the power supply apparatus to escape to outside the main housing 10.

The charger fan F3 is located close to the charger 52. The charger fan F3 mainly forms a particular air flow in the air close to the charger 52. Note that the charger fan F3 is schematically shown in FIG. 2.

As shown in FIG. 3, the image forming apparatus 1 further includes a plurality of motors, a plurality of clutches, and a plurality of solenoids.

Specifically, the image forming apparatus 1 includes a first motor M1, a second motor M2, a third motor M3, a fourth motor M4, and a paper discharge motor M5. The first motor M1, the second motor M2, the third motor M3, the fourth motor M4, and the paper discharge motor M5 are controlled by the controller CU.

The first motor M1 drives a conveyance mechanism to convey the sheet S. Specifically, the first motor M1 drives the paper feed roller 23, the separation roller 24, the conveyance roller 26, the registration roller 27, and the reconveyance rollers 94 and 95; which constitute the conveyance mechanism, to convey the sheet S.

The second motor M2 drives the photosensitive drum 50, the drive roller 71, and the cleaning roller 75A. Specifically, the second motor M2 drives the first photosensitive drum 50Y, the second photosensitive drum 50M, the third photosensitive drum 50C, and the fourth photosensitive drum 50K.

The third motor M3 drives a plurality of developing rollers 61 respectively to rotate the same, to drive the separation mechanism of the developing roller 61, and to drive the nip adjustment mechanism of the fixing device 80. The separation mechanism of the developing roller 61 is a mechanism to individually move the respective developing rollers 61 between a contact position at which the developing roller 61 contacts the corresponding photosensitive drum 50 and a separation position at which the developing roller 61 is separated from the photosensitive drum 50.

The fourth motor M4 drives the fixing device 80. Specifically, the fourth motor M4 drives the pressure roller 82 and the fixing outlet roller 80A.

The paper discharge motor M5 is located above the fixing device 80. The paper discharge motor M5 drives the conveyance roller 15 and the discharge roller 16.

The image forming apparatus 1 further includes a paper feed clutch C1, a registration clutch C2, a color development separation clutch C3, a monochrome development separation clutch C4, a nip release clutch C5, a belt cleaning clutch C6, and a reconveyance path clutch C7. The paper feed clutch C1, the registration clutch C2, the color development separation clutch C3, the monochrome development separation clutch C4, the nip release clutch C5, the belt cleaning clutch C6, and the reconveyance path clutch C7 are controlled by the controller CU.

The paper feed clutch C1 switches between a transmission state in which the driving force of the first motor M1 is transmitted to the paper feed roller 23 and the separation roller 24 and a non-transmission state in which the driving force of the first motor M1 is not transmitted to the paper feed roller 23 and the separation roller 24.

The registration clutch C2 switches between the transmission state in which the driving force of the first motor M1 is transmitted to the registration roller 27 and the non-transmission state in which the driving force of the first motor M1 is not transmitted to the registration roller 27.

The color development separation clutch C3 switches between the transmission state in which the driving force of the third motor M3 is transmitted to the separation mechanism that moves the first development cartridge 60Y, the second development cartridge 60M, and the third development cartridge 60C and the non-transmission state in which the driving force of the third motor M3 is not transmitted to the separation mechanism.

The monochrome development separation clutch C4 switches between the transmission state in which the driving force of the third motor M3 is transmitted to the separation mechanism that moves the fourth development cartridge 60K and the non-transmission state in which the driving force of the third motor M3 is not transmitted to the separation mechanism.

The nip release clutch C5 switches between the transmission state in which the driving force of the third motor M3 is transmitted to the nip adjustment mechanism and the non-transmission state in which the driving force of the third motor M3 is not transmitted to the nip adjustment mechanism.

The belt cleaning clutch C6 switches between the transmission state in which the driving force of the second motor M2 is transmitted to the cleaning roller 75A and the non-transmission state in which the driving force of the second motor M2 is not transmitted to the cleaning roller 75A.

The reconveyance path clutch C7 switches between the transmission state in which the driving force of the first motor M1 is transmitted to the reconveyance rollers 94 and 95 and the non-transmission state in which the driving force of the first motor M1 is not transmitted to the reconveyance rollers 94 and 95.

The image forming apparatus 1 further includes a flapper solenoid N1 and a manual feed tray solenoid N2. The flapper solenoid N1 and the manual feed tray solenoid N2 are controlled by the controller CU.

The flapper solenoid N1 drives the flapper 91 to rotationally move between the third position and the fourth position.

The manual feed tray solenoid N2 moves the pickup roller 29. The pickup roller 29 moved by the manual feed tray solenoid N2 conveys the sheets S placed in the manual feed tray 28 to the registration roller 27 one sheet at a time.

Figure 4:
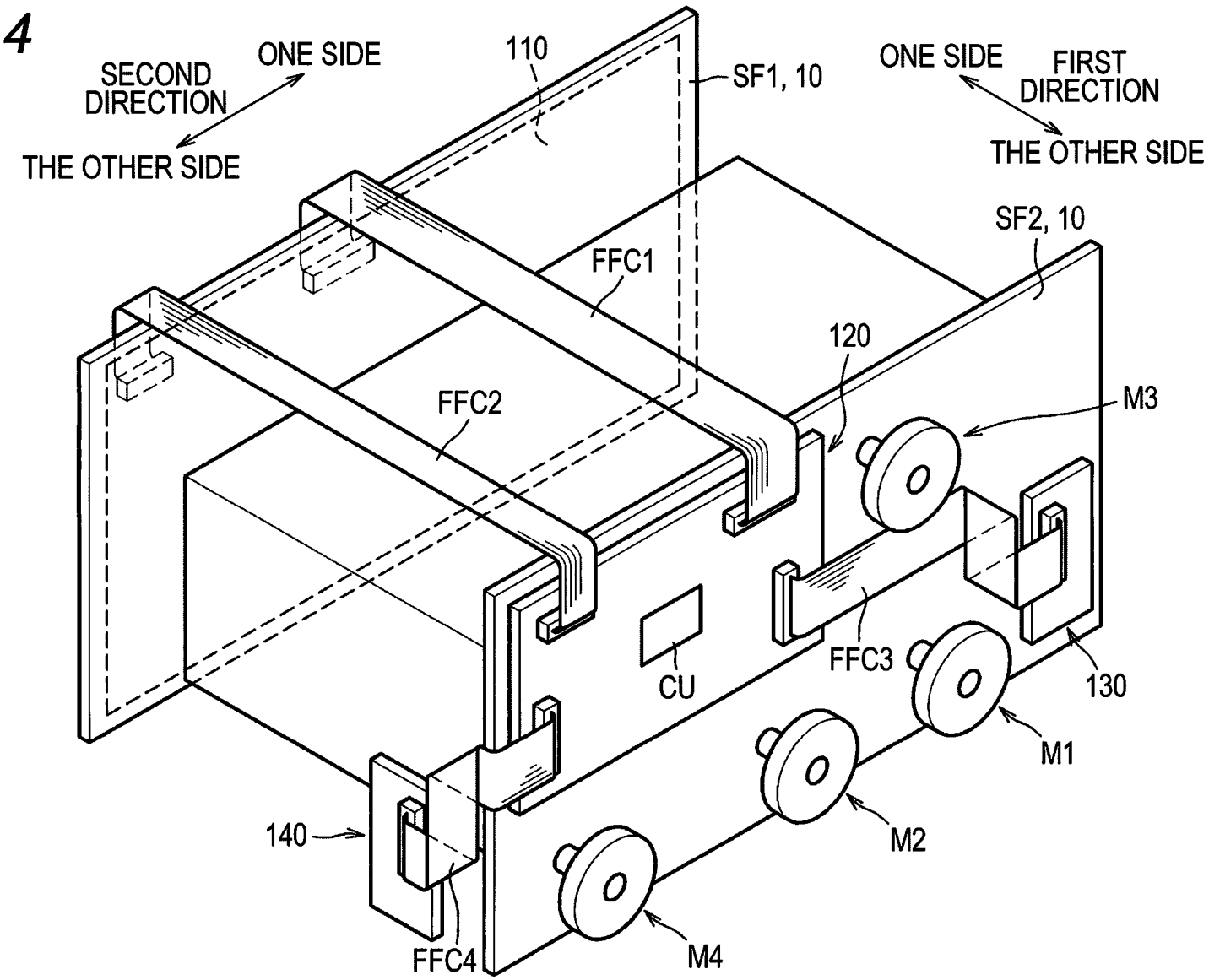
FIG. 4 is a perspective view illustrating the positions of a high-voltage electrical circuit board, a control board, and four motors.

As shown in FIG. 4, the image forming apparatus 1 further includes a high-voltage electrical circuit board 110, a control board 120, a first sub-control board 130, a second sub-control board 140, a first flexible flat cable FFC1, a second flexible flat cable FFC2, a third flexible flat cable FFC3, and a fourth flexible flat cable FFC4.

Figure 5:
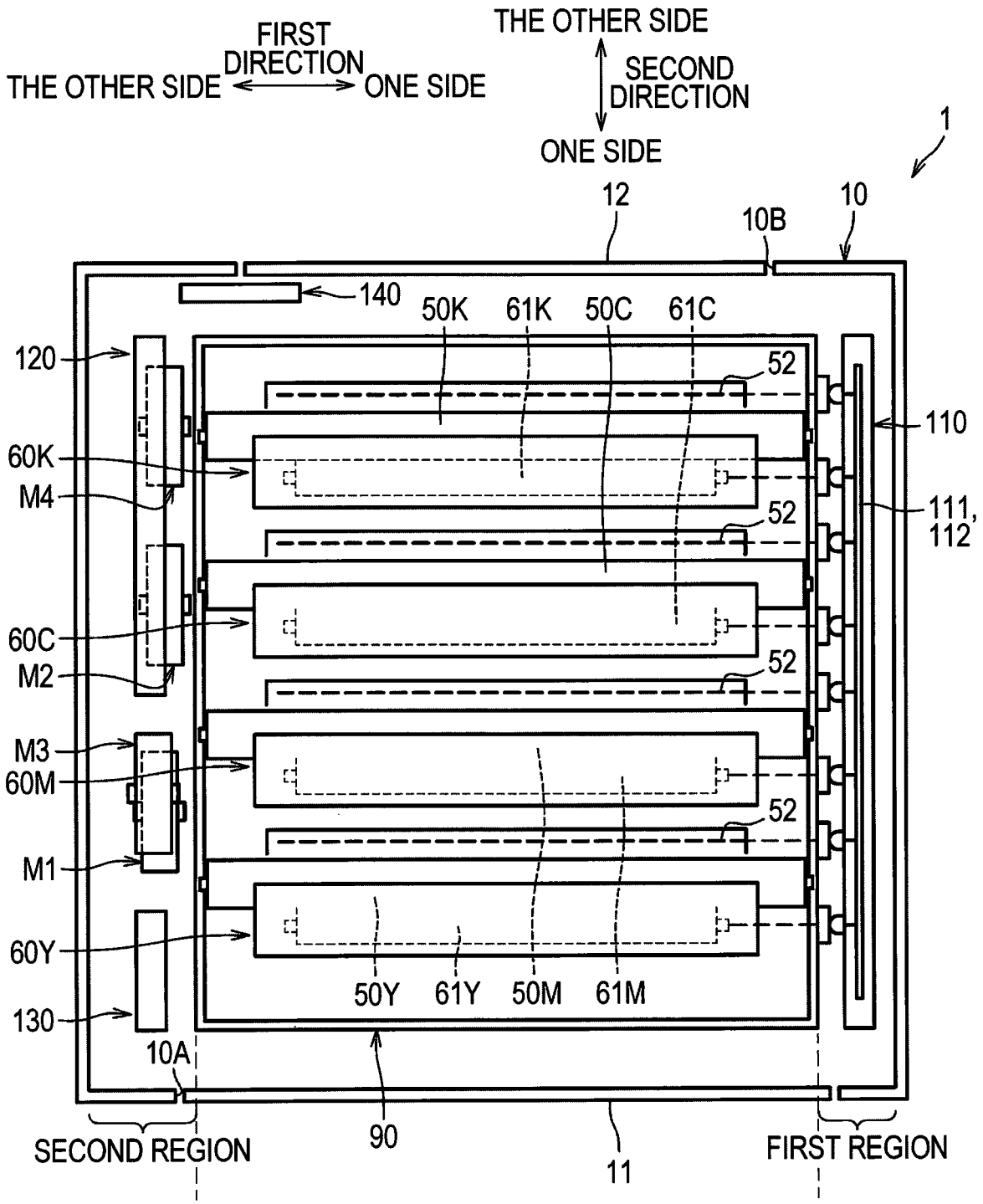
FIG. 5 is a diagram of the image forming apparatus as viewed from above.

The high-voltage electrical circuit board 110 is located at one side of the main housing 10 in the first direction. The high-voltage electrical circuit board 110 is fixed to a first side frame SF1. The first side frame SF1 is a frame located at one side of the main housing 10 in the first direction. As shown in FIG. 5, the high-voltage electrical circuit board 110 is located in a region at one side of the photosensitive drums 50 in the first direction and in a first region at the outer side of the photosensitive drums 50 in the first direction. The high-voltage electrical circuit board 110 is fixed to the outer surface of the first side frame SF1 opposite the surface facing the photosensitive drums 50.

Figure 6:
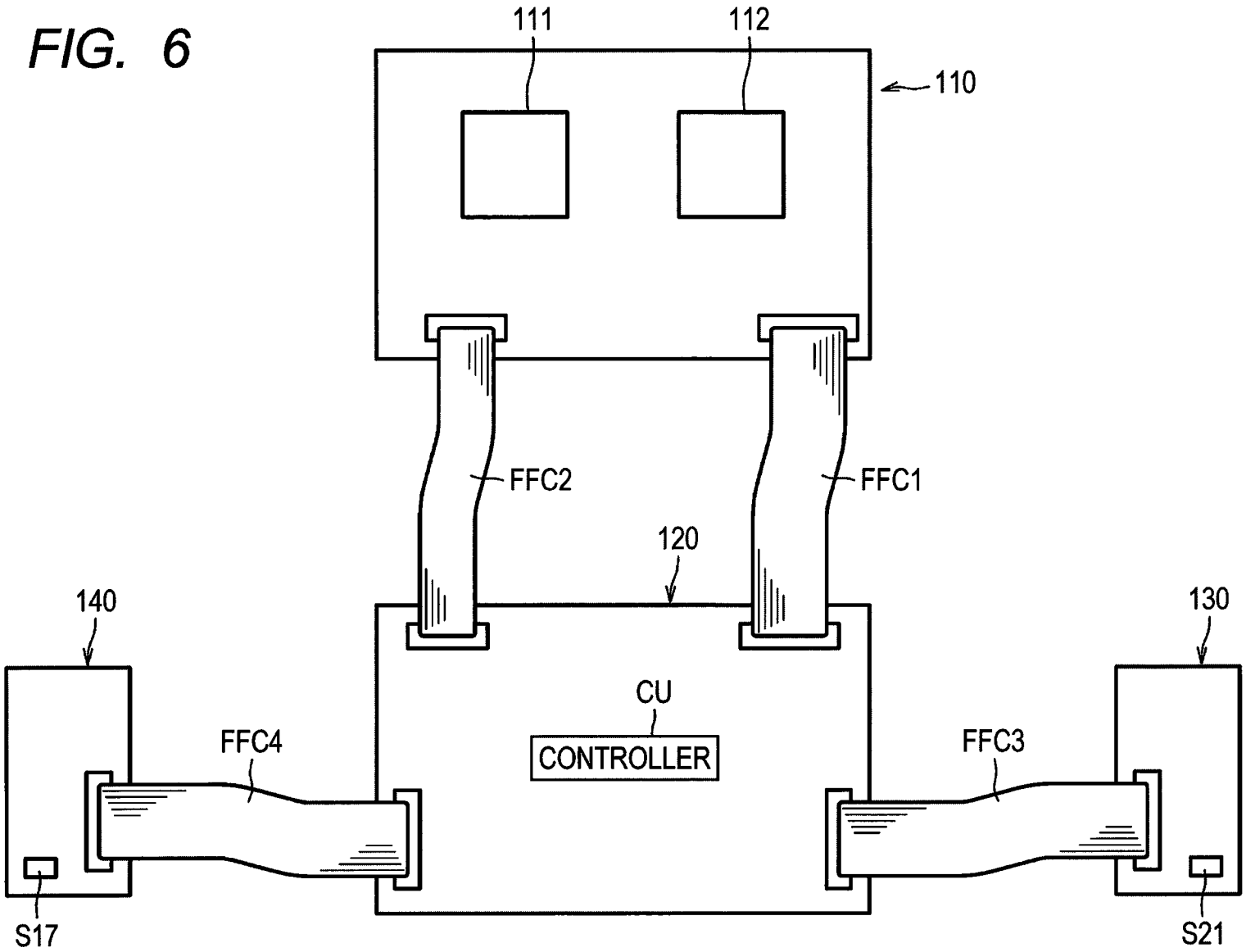
FIG. 6 is a diagram illustrating the connection of the control board, the high-voltage electrical circuit board, and sub-control boards.

As shown in FIG. 6, the high-voltage electrical circuit board 110 is electrically connected to the control board 120. The first sub-control board 130 is electrically connected to the control board 120. The second sub-control board 140 is electrically connected to the control board 120.

In particular, the first flexible flat cable FFC1 and the second flexible flat cable FFC2 electrically connect the control board 120 and the high-voltage electrical circuit board 110. The first flexible flat cable FFC1 is separated from the second flexible flat cable FFC2 by a particular distance.

The third flexible flat cable FFC3 electrically connects the control board 120 and the first sub-control board 130. The fourth flexible flat cable FFC4 electrically connects the control board 120 and the second sub-control board 140.

Figure 7:
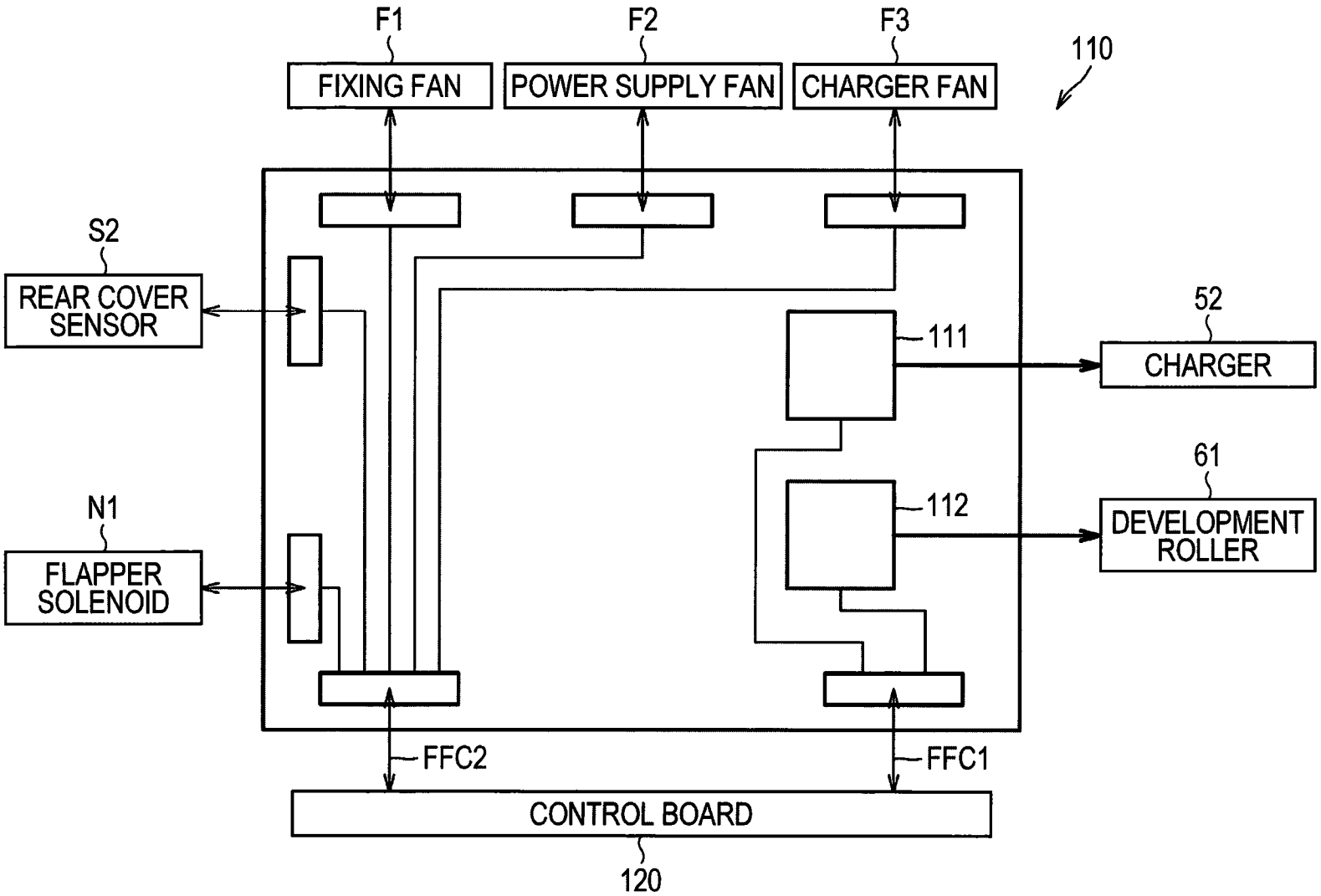
FIG. 7 is a diagram illustrating circuits and terminals of the high-voltage electrical circuit board.

As shown in FIG. 7, the high-voltage electrical circuit board 110 has a first applying circuit 111 and a second applying circuit 112. The first applying circuit 111 applies a voltage (specifically, a high voltage) to the charger 52. The second applying circuit 112 applies a voltage (specifically, a high voltage) to the developing roller 61.

The first applying circuit 111 and the second applying circuit 112 are controlled by the controller CU. Specifically, the first applying circuit 111 and the second applying circuit 112 are electrically connected to the controller CU of the control board 120 via the first flexible flat cable FFC1. An instruction from the controller CU is sent to the high-voltage electrical circuit board 110 via the first flexible flat cable FFC1.

The high-voltage electrical circuit board 110 has connection terminals configured to be electrically connected to the fixing fan F1, the power supply fan F2, the charger fan F3, the rear cover sensor S2, and the flapper solenoid N1, respectively. The instruction from the controller CU is sent from the high-voltage electrical circuit board 110 to the fixing fan F1, the power supply fan F2, the charger fan F3, and the flapper solenoid N1 via the second flexible flat cable FFC2. The signal received from the rear cover sensor S2 is sent from the high-voltage electrical circuit board 110 to the controller CU of the control board 120 via the second flexible flat cable FFC2.

As shown in FIG. 4 and FIG. 5, the control board 120 is located at the other side of the main housing 10 in the first direction. The control board 120 is fixed to a second side frame SF2. The second side frame SF2 is a frame located at the other side of the main housing 10 in the first direction. The control board 120 is located in a region at the other side of the photosensitive drums 50 in the first direction and is in a second region at the outer side of the photosensitive drums 50 in the first direction. The control board 120 is fixed to the outer surface of the second side frame SF2 opposite the surface facing the photosensitive drums 50.

Figure 8:
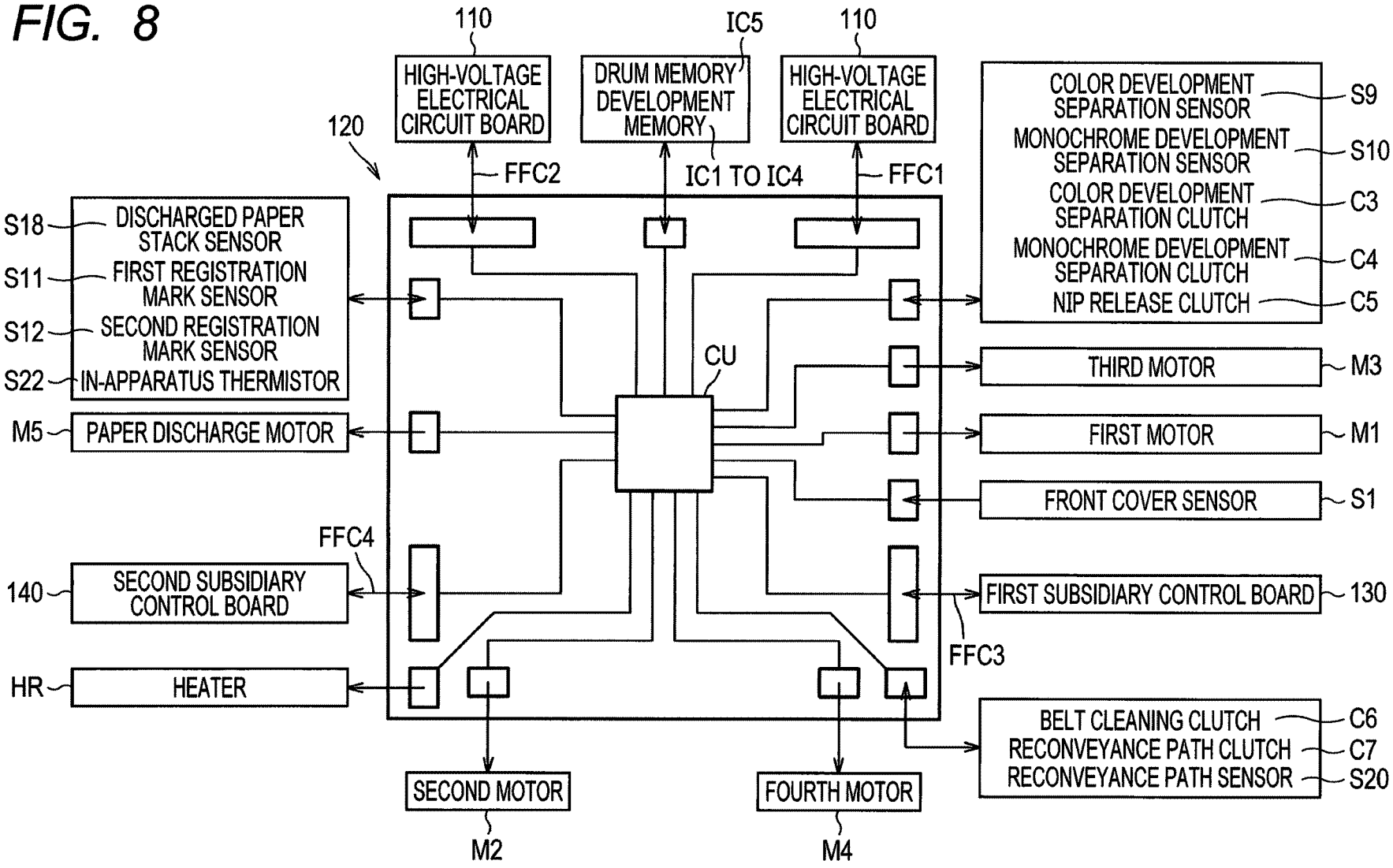
FIG. 8 is a diagram illustrating the connection between the control board and other devices.

As shown in FIG. 8, the control board 120 has, in addition to the controller CU, connection terminals configured to be electrically connected to the development memories IC1-IC4, the drum memory IC5, the discharged paper stack sensor S18, the first registration mark sensor S11, the second registration mark sensor S12, the in-apparatus thermistor S22, the paper discharge motor M5, the heater HR, the second motor M2, the fourth motor M4, the reconveyance path sensor S20, the reconveyance path clutch C7, the belt cleaning clutch C6, the front cover sensor 51, the first motor M1, the third motor M3, the nip release clutch C5, the monochrome development separation clutch C4, the color development separation clutch C3, the monochrome development separation sensor S10, and the color development separation sensor S9, respectively.

The information on the development memories IC1-IC4 and the drum memory IC5 is read by the controller CU or is written by the controller CU. The signals received from the discharged paper stack sensor S18, the first registration mark sensor S11, the second registration mark sensor S12, the in-apparatus thermistor S22, the reconveyance path sensor S20, the front cover sensor S1, the monochrome development separation sensor S10, and the color development separation sensor S9 are sent to the controller CU. The instruction from the controller CU is sent to the paper discharge motor M5, the heater HR, the second motor M2, the fourth motor M4, the reconveyance path clutch C7, the belt cleaning clutch C6, the first motor M1, the third motor M3, the nip release clutch C5, the monochrome development separation clutch C4, and the color development separation clutch C3.

As shown in FIG. 4 and FIG. 5, the first sub-control board 130 is another electrical circuit board located at a different position from the position of the control board 120. The first sub-control board 130 is located at the other side of the main housing 10 in the first direction. The first sub-control board 130 is fixed to the second side frame SF2. The first sub-control board 130 is located in the second region.

Figure 9:
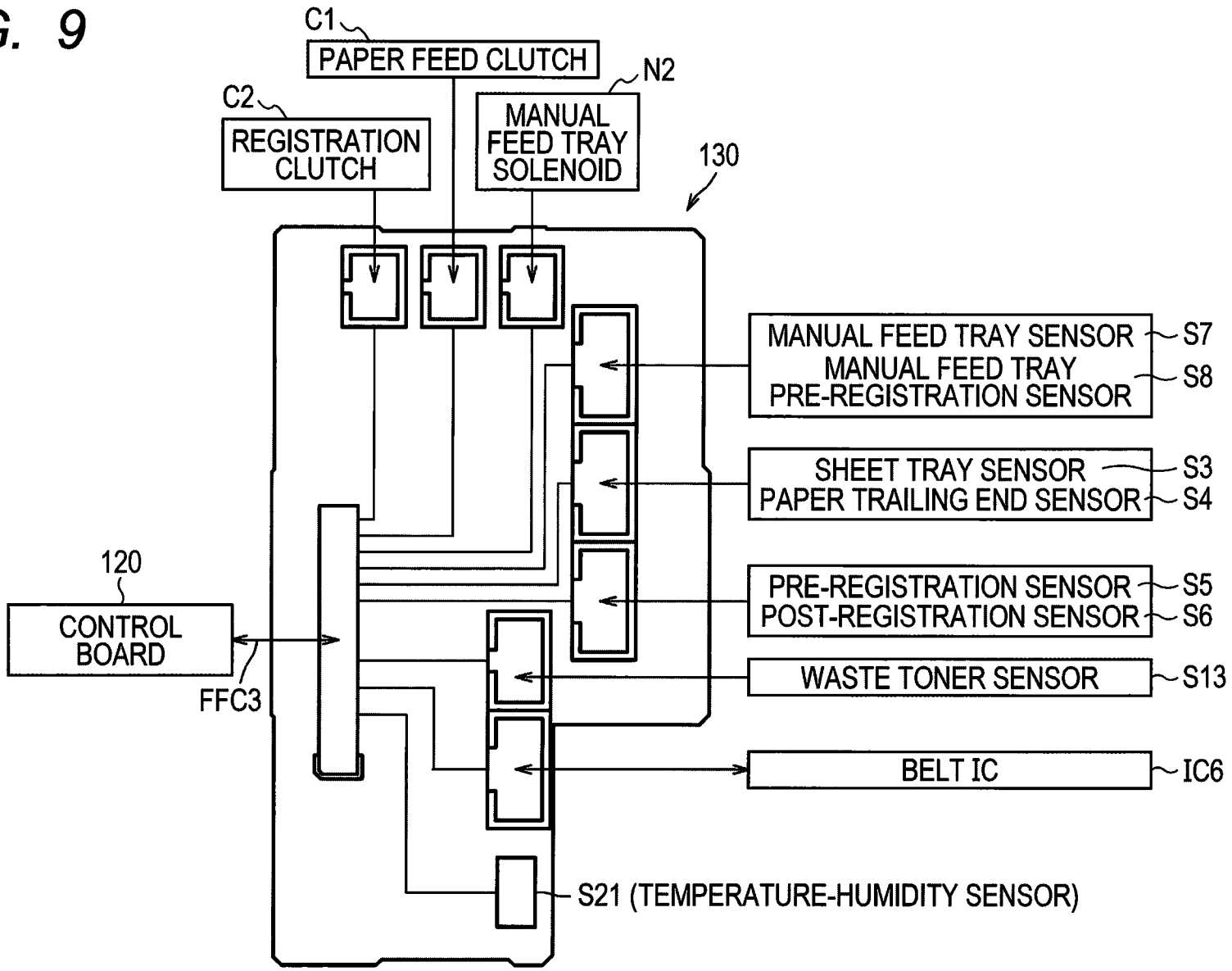
FIG. 9 is a diagram illustrating the connection between a first sub-control board and other devices.

As shown in FIG. 9, the first sub-control board 130 has, in addition to the temperature-humidity sensor S21, connection terminals configured to be electrically connected to the registration clutch C2, the paper feed clutch C1, the manual feed tray solenoid N2, the manual feed tray sensor S7, the manual feed tray pre-registration sensor S8, the sheet tray sensor S3, the paper trailing end sensor S4, the pre-registration sensor S5, the post-registration sensor S6, the waste toner sensor S13, and the belt IC, respectively.

The first sub-control board 130 receives signals detected by the temperature-humidity sensor S21, the manual feed tray sensor S7, the manual feed tray pre-registration sensor S8, the sheet tray sensor S3, the paper trailing end sensor S4, the pre-registration sensor S5, the post-registration sensor S6, and the waste toner sensor S13. The signals received from temperature-humidity sensor S21, the manual feed tray sensor S7, the manual feed tray pre-registration sensor S8, the sheet tray sensor S3, the paper trailing end sensor S4, the pre-registration sensor S5, the post-registration sensor S6, and the waste toner sensor S13 are sent from the first sub-control board 130 to the controller CU of the control board 120 via the third flexible flat cable FFC3. The instruction from the controller CU is sent from the first sub-control board 130 to the registration clutch C2, the paper feed clutch C1, and the manual feed tray solenoid N2 via the third flexible flat cable FFC3. The information on the belt memory IC6 is read by the controller CU or is written by the controller CU via the first sub-control board 130.

As shown in FIG. 4 and FIG. 5, the second sub-control board 140 is another electrical circuit board located at a different position from the positions of the control board 120 and the first sub-control board 130. The second sub-control board 140 is located at the other side of the main housing 10 in the first direction. Specifically, a part of the second sub-control board 140 is located in the second region (see FIG. 5).

Figure 10:
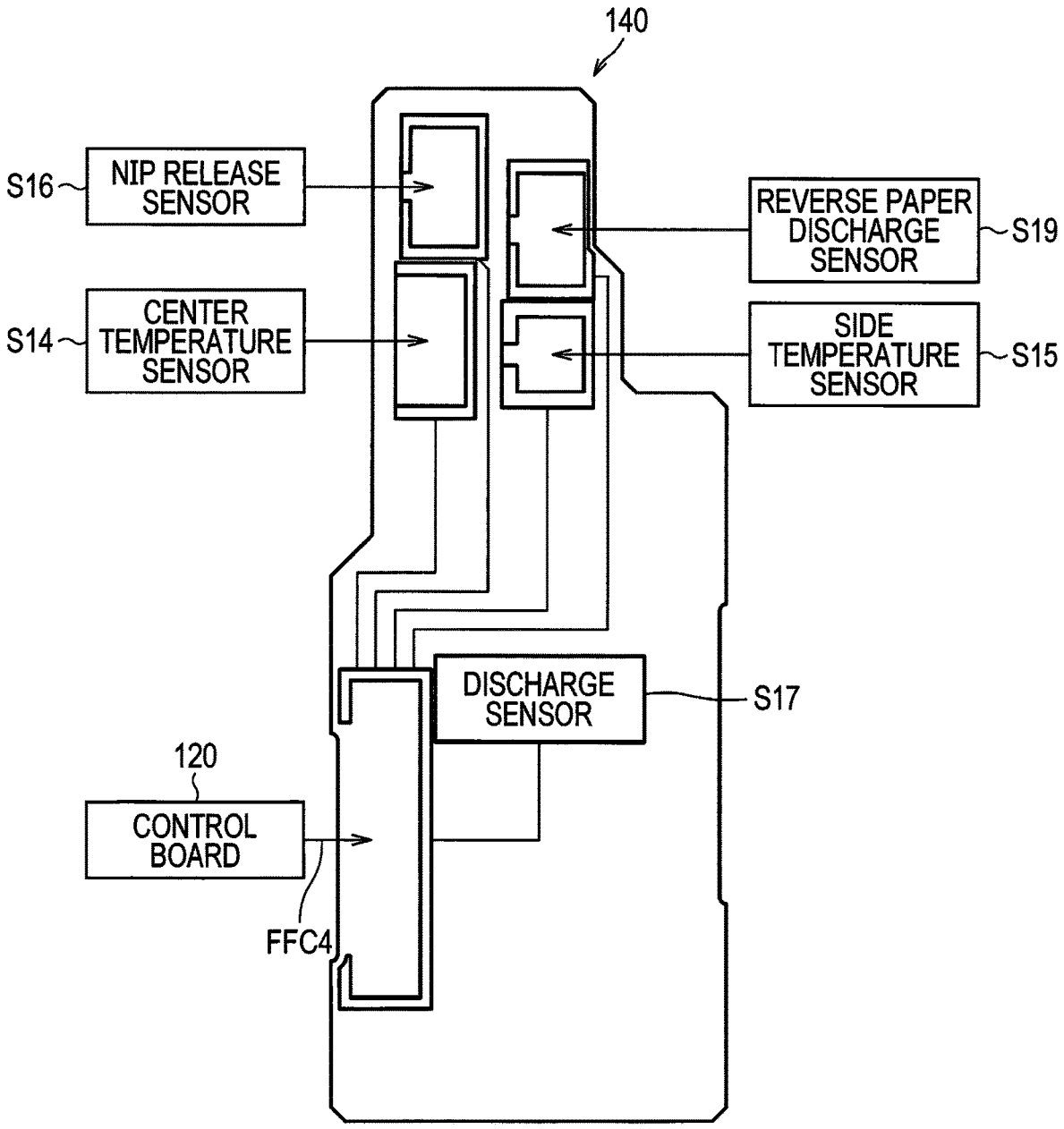
FIG. 10 is a diagram illustrating the connection between a second sub-control board and other devices.

As shown in FIG. 10, the second sub-control board 140 has, in addition to the discharge sensor S17, connection terminals configured to be electrically connected to the nip release sensor S16, the center temperature sensor S14, the reverse paper discharge sensor S19, and the side temperature sensor S15, respectively. The signals received from the discharge sensor S17, the nip release sensor S16, the center temperature sensor S14, the reverse paper discharge sensor S19, and the side temperature sensor S15 are sent from the second sub-control board 140 to the controller CU of the control board 120 via the fourth flexible flat cable FFC4.

Figure 11:
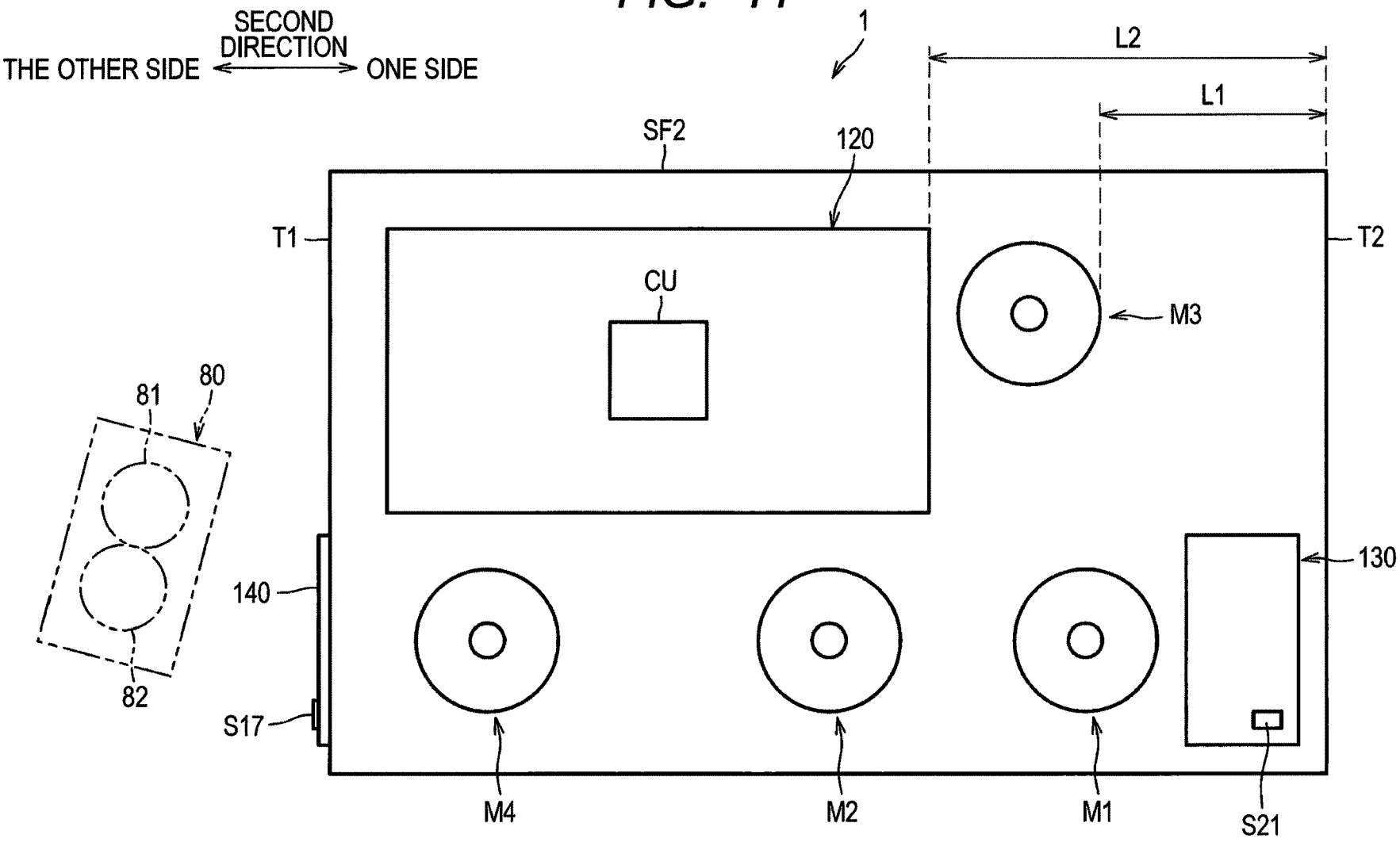
FIG. 11 is a diagram of the image forming apparatus as viewed from an axial direction, which illustrates the arrangement of the control board and each motor.

As shown in FIG. 5, the first motor M1, the second motor M2, the third motor M3, and the fourth motor M4 are located in the second region. The first motor M1, the second motor M2, the third motor M3, and the fourth motor M4 are fixed to the second side frame SF2. As shown in FIG. 11, the first motor M1, the second motor M2, the third motor M3, the fourth motor M4, and the control board 120 are located at different positions from one another in the second region. The first sub-control board 130 is located at a different position from the positions of the first motor M1, the second motor M2, the third motor M3, the fourth motor M4, and the control board 120 in the second region.

The second motor M2 is located to be aligned with the first motor M1 in the second direction. That is, the first motor M1 and the second motor M2 are arranged in the second direction. The third motor M3 is located at a higher position than the first motor M1. The third motor M3 is located between the control board 120 and the first sub-control board 130 in the second direction. The control board 120 is located between the third motor M3 and the second sub-control board 140 in the second direction.

The main housing 10 has a first end T1 close to the fixing device 80 in the second direction and a second end T2 far from the fixing device 80 in the second direction. A distance L1 from the second end T2 to the third motor M3 is shorter than a distance L2 from the second end T2 to the control board 120.

According to the image forming apparatus 1 of the present embodiment described above, the following effects can be obtained.

As shown in FIG. 5, in the image forming apparatus 1, the high-voltage electrical circuit board 110 is located in the first region, and the first motor M1, the second motor M2, the third motor M3, and the control board 120 are located in the second region. Therefore, each of the first motor M1, the second motor M2, the third motor M3, and the control board 120 is located at a particular distance from the high-voltage electrical circuit board 110, and the first motor M1, the second motor M2, the third motor M3, and the control board 120 are located at different positions from one another. As a result, the influence of the high frequency noise of the high-voltage electrical circuit board 110 on the first motor M1, the second motor M2, the third motor M3 and the control board 120 can be suppressed, and an increase in the size of the image forming apparatus 1 in the axial direction of the developing roller 61 can be suppressed.

Further, the second flexible flat cable FFC2 is separated from the first flexible flat cable FFC1 by a particular distance. This suppresses the influence of the high frequency noise that is transmitted to the fixing fan F1, the power supply fan F2, the charger fan F3, the rear cover sensor S2, and the flapper solenoid N1.

While the disclosure has been described in detail with reference to the above aspects thereof, it would be apparent to those skilled in the art that various changes and modifications may be made therein without departing from the scope of the claims.

In the above-described embodiment, the second direction is a direction crossing the first direction. However, the second direction may be the same as the first direction.

In the above-described embodiment, the applying circuit is configured to apply a high voltage to both of the charger and the developing roller. Alternatively, the applying circuit may be configured to apply a high voltage to either one of the charger and the developing roller.

In the above-described embodiment, the image forming apparatus 1 configured to print a color image by using four colors of toner has been illustrated. Alternatively, the image forming apparatus may be configured to perform only monochrome printing, or may be configured to print color images by using three or five or more colors of toner.

The image forming apparatus may be a multifunction peripheral or a copier.

The elements described in the above embodiments and modifications may be combined as appropriate.

What is claimed is:

1. An image forming apparatus comprising:

a main housing;

a plurality of developing rollers, each of the plurality of developing rollers rotatable about a first axis extending in a first direction, the plurality of developing rollers being arranged in a second direction;

a drum unit including:

a plurality of photosensitive drums provided for respective ones of the plurality of developing rollers, each of the plurality of photosensitive drums rotatable about a second axis extending in the first direction; and a plurality of chargers each configured to charge a surface of a corresponding one of the plurality of photosensitive drums;

a high-voltage electrical circuit board located in a first region that is a region at one side of the plurality of photosensitive drums in the first direction and outside of the plurality of photosensitive drums in the first direction, the high-voltage electrical circuit board including a first applying circuit configured to apply a voltage to the plurality of chargers;

a first motor located in a second region that is a region at an other side of the plurality of photosensitive drums in the first direction and outside of the plurality of photosensitive drums in the first direction, the other side being opposite the one side, the first motor being configured to drive a conveyance mechanism configured to convey a sheet;

a second motor located in the second region and configured to drive each of the plurality of photosensitive drums;

a third motor located in the second region, the third motor being configured to drive each of the plurality of developing rollers to rotate and to drive a separation mechanism configured to individually move the plurality of developing rollers between a contact position at which each of the plurality of developing rollers contacts a corresponding one of the plurality of photosensitive drums and a separation position at which each of the plurality of developing rollers is separated from the corresponding one of the plurality of photosensitive drums; and a control board located in the second region, the control board including a controller configured to control the first applying circuit, the first motor, the second motor, and the third motor, the first motor, the second motor, the third motor, and the control board being located at different positions from one another in the second region.

2. The image forming apparatus according to claim 1, further comprising a fixing device configured to fix toner on a sheet, wherein the main housing has a first end and a second end, the first end being closer to the fixing device in the second direction than the second end is; and wherein a distance from the second end to the third motor is shorter than a distance from the second end to the control board.

3. The image forming apparatus according to claim 1, wherein the first motor and the second motor are arranged in the second direction.

4. The image forming apparatus according to claim 1, wherein the third motor is located at a higher position than the first motor.

5. The image forming apparatus according to claim 1, wherein the high-voltage electrical circuit board includes a second applying circuit configured to apply a voltage to the plurality of developing rollers.

6. The image forming apparatus according to claim 1, further comprising:

a fixing device configured to fix toner on a sheet; and a fourth motor configured to drive the fixing device, the fourth motor being located at a different position from the first motor, the second motor, the third motor, and the control board in the second region.

7. The image forming apparatus according to claim 1, further comprising:

a sheet tray configured to accommodate a sheet;

a sheet tray sensor configured to detect a sheet placed on the sheet tray; and a first sub-control board electrically connected to the control board, the first sub-control board being located at a different position from the first motor, the second motor, the third motor, and the control board in the second region, the first sub-control board being configured to receive a signal from the sheet tray sensor, wherein the third motor is located between the control board and the first sub-control board in the second direction.

8. The image forming apparatus according to claim 7, wherein the first sub-control board includes a temperature-humidity sensor.

9. The image forming apparatus according to claim 1, further comprising:

a fixing device configured to fix toner on a sheet;

a discharge sensor configured to detect that a sheet is discharged from the fixing device; and a second sub-control board electrically connected to the control board, the discharge sensor being provided on the second sub-control board, wherein the control board is located between the third motor and the second sub-control board in the second direction.

10. The image forming apparatus according to claim 1, wherein the main housing has an opening at one side in the second direction; and wherein the drum unit is configured to be attached to the main housing or detached from the main housing through the opening.

11. The image forming apparatus according to claim 1, wherein the second direction is a direction crossing the first direction.

* * * * *